US008291961B2

(12) United States Patent
Grun

(10) Patent No.: US 8,291,961 B2
(45) Date of Patent: Oct. 23, 2012

(54) DEVICE WITH PROTECTION NET AND ASSEMBLY PROCEDURE SUITABLE AS BARRIER FOR ALL KINDS OF OPENINGS

(76) Inventor: Andrea Luisa Grun, Ciudad Autonoma de Buenos Aires (AR)

( * ) Notice: Subject to any disclaimer, the term of this patent is extended or adjusted under 35 U.S.C. 154(b) by 324 days.

(21) Appl. No.: 12/649,587

(22) Filed: Dec. 30, 2009

(65) Prior Publication Data

US 2011/0154739 A1 Jun. 30, 2011

(51) Int. Cl.
*E06B 3/30* (2006.01)

(52) U.S. Cl. ..... 160/371; 52/202

(58) Field of Classification Search ..... 160/371–404; 38/102.91; 40/603–604; 52/202
See application file for complete search history.

(56) References Cited

U.S. PATENT DOCUMENTS 1,461,441 A * 7/1923 Davis ..... 160/378
1,819,776 A * 8/1931 Heck ..... 359/445
2,163,359 A * 6/1939 Van Derveer ..... 160/378
2,225,167 A * 12/1940 Farmer ..... 160/373
2,265,375 A * 12/1941 Julien et al. ..... 160/378
3,353,232 A * 11/1967 Brownson ..... 24/129 R
4,098,493 A * 7/1978 Logan ..... 256/24
4,127,156 A * 11/1978 Brandt ..... 160/179
4,221,038 A * 9/1980 Singer et al. ..... 29/897.15
4,878,531 A * 11/1989 Stover ..... 160/327
5,127,460 A * 7/1992 Abadi et al. ..... 160/332
5,507,109 A * 4/1996 Rinzler ..... 40/603
5,579,794 A * 12/1996 Sporta ..... 135/88.01
6,854,488 B2 * 2/2005 Hay et al. ..... 139/383 A
7,090,905 B1 * 8/2006 Brauner ..... 428/35.7
2003/0196770 A1 * 10/2003 Wylie ..... 160/371
2008/0110583 A1 * 5/2008 Lallemand ..... 160/371
2008/0289780 A1 * 11/2008 McGregor et al. ..... 160/371

* cited by examiner

*Primary Examiner* — Katherine W Mitchell
*Assistant Examiner* — Johnnie A Shablack
(74) *Attorney, Agent, or Firm* — Defillo & Associates, Inc; Evelyn A Defillo

(57) ABSTRACT

This invention refers to a device with protection net and assembly procedure, suitable as a barrier for every kind of opening. It uses profiles especially designed and made up of plastic material (polyamide) with fiberglass, thus allowing mass production and easy handling. It also counts on assembly and tie means integrally related to a safety mesh-like net to be used as a retaining barrier in balconies, terraces, windows, and stairways preferably. It will reduce the risk of children and/or careless people falls in a safe, economical and esthetical manner.

3 Claims, 3 Drawing Sheets

DEVICE WITH PROTECTION NET AND ASSEMBLY PROCEDURE SUITABLE AS BARRIER FOR ALL KINDS OF OPENINGS

FIELD OF THE INVENTION

This invention corresponds to a protection device composed of a woven mesh or protection net associated to a number of plastic profiles (polyamide with fiberglass) with special tie means suitable mainly as a barrier in balconies, terraces, windows, staircases and mezzanines, which will secure you, in a safety, economic and esthetic manner, a risk reduction of children and/or careless people as well as pets falls through all kind of openings.

BACKGROUND OF THE PRIOR ART

As regards previous devices, there are plastic and/or metallic weaves, or plastic and glass plate's applications which are placed against the window or balcony openings; all of them aimed at preventing people, especially kids, from falling.

Among the problems and limitations found in the plastic and metallic nets devices, the following can be mentioned: lack of visibility that such materials cause, lack of esthetics when having elements which are not tightened all along the surface, and especially the installation efficiency, lack of safety due to low endurance or poor mesh or net anchorages used. Besides, the installation of these weaves must be carried out by specialized personnel since special tools are needed; thus, raising the installation costs of said protection weaves.

As regards clear plastic or glass plates devices, their cost is quite high, plus the disadvantage of limiting the openings, which does not allow the air to flow.

Another similar protection device consists of installing a net or mesh tightened by means of a rope in the perimeter threaded to the same net or mesh; once the rope is tightened, that action makes the whole net or mesh to tighten. This rope is attached with ordinary fixing elements (staples, hook screws, etc), and in order to tighten it, a manual force is applied if there is no other traction element to count on.

One of the drawbacks of this kind of application is the sum of risk factors such as: net or mesh highly tightened; rope in the perimeter, from which safety and net performance depend on, scarcely tightened; fixing elements failure, whether individually or collectively; anchorages ageing or rust; incorrectly anchorages lineup causing an unsatisfactory result.

There is also another device composed of a mesh-like net made up of threads forming a large quantity of squares, and of profiles, mainly the "L" ones, fastening the opening. A tightening element like a wire bended as a "U" used as cotter pin, which is inserted in each square of the mesh-like net edge, will be put into existing holes along the fastening profiles mentioned, so as to enable the tightening of the mesh-like net. Aluminum from profiles may be selected among raw aluminum, anodized aluminum and/or oven-painted aluminum.

One of the drawbacks consists of using a wire-like tightening element and metallic profiles which may become a risk of hurting, pricking or scratching for kids and adults who have access to those installations.

In addition, the risk of having sharp edges which may really hurt users of this device as well as damage the net.

Another disadvantage as regards installation with aluminum profiles is that qualified labor is used for a perfect assembly in the disposition and lineup of the profiles as well as in the adjustment of the tightening elements of the net, resulting in higher costs and the limitation of not finding qualified labor in the place you need the device.

SUMMARY OF THE INVENTION

The device with protection net of this invention comprises a mesh-like net that is preferably available in clear or white material formed by monofilament threads outlining mono-threads and multi-threads knotless-woven, high tenacity and endurance "raschel"-like mesh that make up a plurality of rhombus, which is installed in the whole open surface to be protected. One of the advantages of the abovementioned net is that it requires neither cleaning, nor painting and that said net guarantees a perfect view through it; it also achieves an undistorted appearance of the apartment or house and does not diminish the room light.

Its endurance is guaranteed by the absolute weave's discontinuity, in such a way that a possible breakage is interrupted in the thermo-sealed or thermo-fused knot next to the mesh, allowing its simple repair.

Installation is simple thanks to the special design of the profile; the necessary quantity is used in relation to the surface size to be protected. They are injected with a plastic material (fiberglass reinforced polyamide) and have a space described by a "guide" line in between "tie means". This will enable the fastening of said profiles, through screws, wooden pegs and tie means incorporated to said profile and that will be fixed to the structure (floors/flagstones/lintels, etc.) by safe wooden bits so as to achieve a perfect assembly of the mesh-like net.

The net or mesh will be securely anchored to the profile in any position as required by the site to be protected thanks to the "anchor"-like tie means design that, due to its morphology, may be placed in all possible positions and directions ensuring, in all cases, that there is no way the net might "untie".

Among the "tie means" there is a space that will allow drilling the profile wherever convenient, according to the surface requirements or restrictions to which it shall be stuck.

The proposed device has the following advantages:

It has profiles made of a plastic material (polymeric material) with fiberglass components allowing a condition of mass production and easy handling.

Profiles are installed in any position, it does not matter which, developing different configurations based on the surface to be protected, and avoiding, due to its morphology, that the net slides and gets untied.

Profiles may be dyed with the colors of the walls in order to obtain the esthetic characteristics of the room to be protected.

Easy installation due to the fewer number of pieces in its assembly.

Saving on raw material, product production and logistics as it is marketed in a "Kit" of in situ assembly installation.

Easy removal in the event of urgencies, thus enabling the access firefighters with telescopic ladders and/or paramedics.

It offers the widest mechanical endurance of the net as said net distributes its strength in a uniform, complete and radial way.

It does not have wrong side; the ending is tidy and well-ended.

BRIEF DESCRIPTION OF THE DRAWINGS

In order to render the object of the invention more intelligible, it has been illustrated by three diagrammatic figures, in its preferred ways, which assume an illustrative example feature, as follows.

DETAILED DESCRIPTION OF THE INVENTION

In all the figures, the same reference numbers state equal or relevant elements, which are as follows:

1. Profile.
2. Opening frame.
3. Upper face.
4. Lower face.
5. Flat region with longitudinal notches (5') to place and drill with fastening means (12).
6. Nicks.
7. Tie means.
8. Arms
9. Net or mesh.
10. Tightness central ribs.
11. Tightness ribs placed on the lower face (4).
12. Fastening means (screws—wooden pegs).

Figure 1:
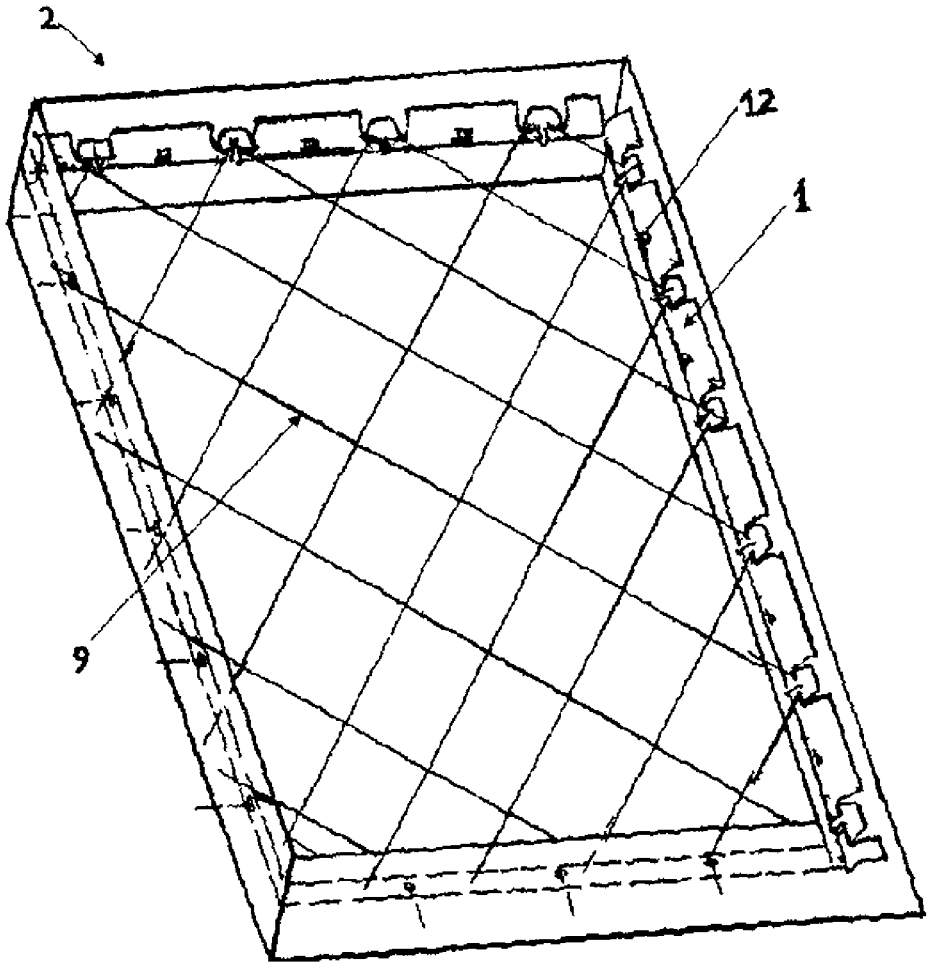
FIG. 1 shows a perspective view of the opening frame over which the device of the protection net of the invention is applied.

In said FIG. 1 there appears the frame 2 over which the mesh-like net 9 is held through the use of its assembly made up of a set of profiles 1 with at least a flat region (5) with longitudinal notches (5') to place and drill with fastening means (12), with multiple nicks (6) evenly apart among them to place tie means (7) in order to tighten and stretch said net (9), with a simple tie in them. FIG. 1 shows the use of the tightening technique by being tied over each tie means 7.

Figure 2:
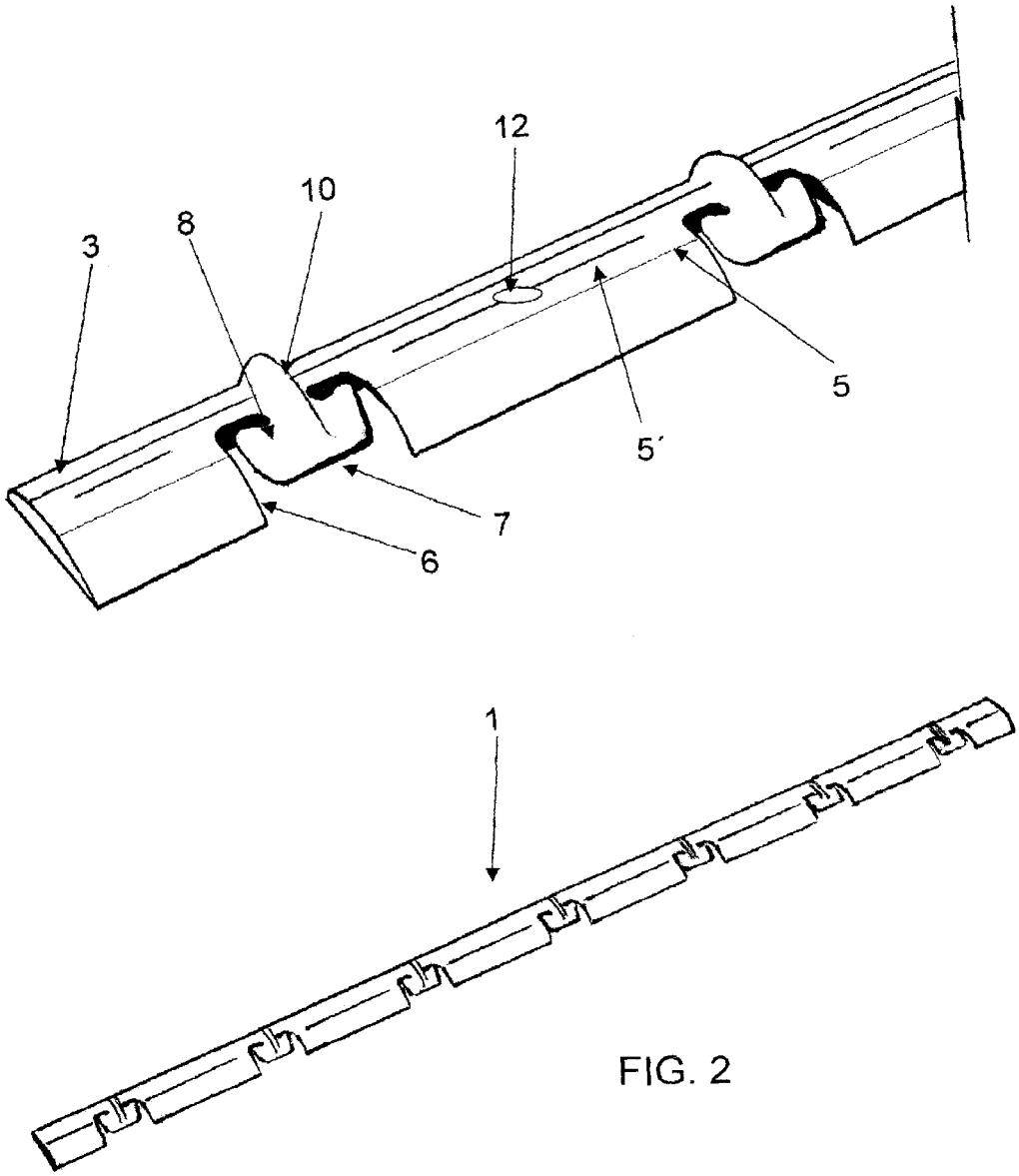
FIG. 2 shows a perspective view of the injected plastic profile, depicting the upper face of the profile.
Figure 3:
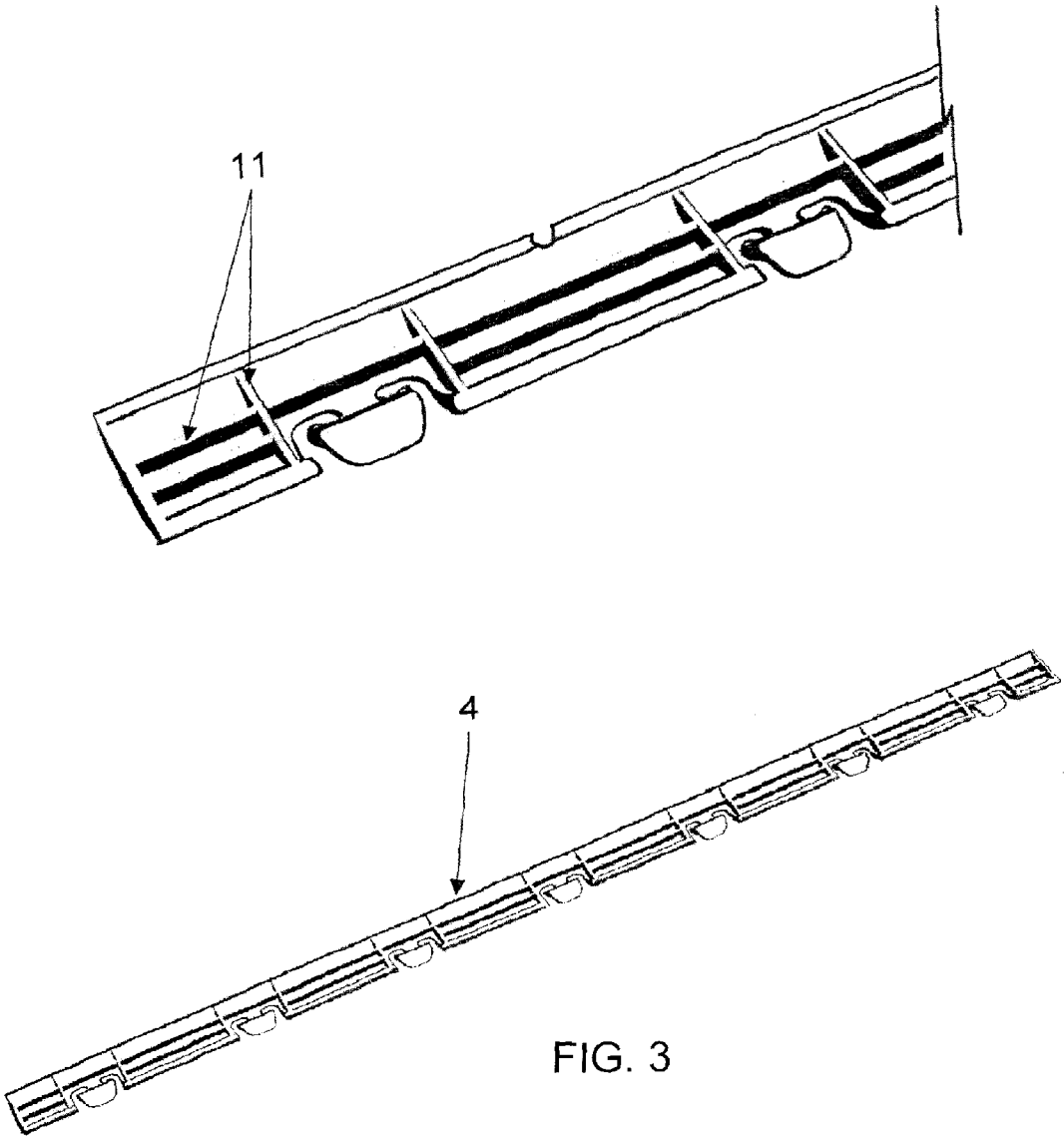
FIG. 3 shows a perspective view of the injected plastic profile, depicting the lower face of the profile.

FIGS. 2 and 3 clearly shows the profiles features (1) which are outlined by long-shaped mono-pieces, of convex cross section (convex) in its upper face and with at least a flat region with longitudinal notches (5') to place and drill with fastening means (12); multiple nicks (6) evenly located apart among them along said profile, which are entirely shown to the tie means (7) of said net (9); said tie means (7) are double hooks similar, in its morphology, to an anchor formed by nail-shaped arms (8) with a central rib giving tightness (10).

The tie means have—as regards the upper face—an upwards concave surface related to their central rib located at the middle part arranged in downwards concave way.

They also have, on the surface of the profile lower face, multiple ribs distributed in a longitudinal and a transverse way in order to render the structure of such profile more tightness.

The fact that the tie means of the protection net constitutes an integral part of the same profile is a very important technical feature.

The assembly procedure of the device in the opening to be protected basically comprises the following stages:

a) Put the profiles (1), preferably 0.50 cm long, from the ends towards the center completing the four sides (high, low, and opening or frame sides) (2), allocate the difference among profiles (if any) and complete by cutting a piece of profile to complete same, following the sequence of the tie means (7); b) Fix the profile sections to wall with at least three screws (12) per section by placing one screw (12) in each end and a third one in the middle, choosing freely the spot where to drill the profile into the wall in the sections between the tie means (7), c) place the net (9) by introducing each rhombus by the vertex in the relevant tie means (7) located at the profile and especially designed to that end and stretching the net so that it remains tight enough and d) cut out the remaining net (9).

We hereby state that the above mentioned and illustrated procedure is just a preferable manner of putting into practice this invention and shall be considered as included under its scope. Any other practice in line with the claims described hereinafter and any term therein referring to position, location and/or shape shall be construed as being the claimed device in normal position and/on adapted.

Being the nature and scope of the invention hereinabove described and represented, and being so the manner the invention has to be put into practice, we hereby claim the following as our exclusive right and ownership.

What is claimed is:

1. A protection net for openings, balconies, terraces, windows, staircases, or mezzanine surfaces, the protection net device consisting of:

a) a plurality of one piece profiles forming an open frame, each one piece profile having a convex upper face, a lower face, the convex upper face including a first curved side, a second curved side, and a central flat section placed between the first curved side and the second curved side, a plurality of nicks are formed on the convex upper face, at least one tie device protrudes from the second curved side towards the first curved side, each tie device including a double hook; and b) a net covering the open frame, the net being made of clear or white threads forming a discontinuous knotless weave producing a series of rhombi, wherein a vertex of each rhombus of the series of rhombi that is adjacent to the at least one tie devices is secured to the double hook of the at least one tie device, ends of each clear or white threads are thermo-sealed or thermo-fused to the corresponding one piece profile;

the protection net is a barrier device to prevent a person from falling from the opening.

2. A protection net for openings, balconies, terraces, windows, staircases, or mezzanine surfaces, the protection net device consisting of:

a) a plurality of one piece profiles forming an open frame, each one piece profile having a convex upper face, a lower face, the convex upper face including a first curved side, a second curved side, and a central flat section placed between the first curved side and the second curved side, a plurality of nicks are formed on the convex upper face, at least one tie device protrudes from the second curved side towards the first curved side, each tie device including a double hook; and b) a net covering the open frame, the net made of clear or white threads forming a discontinuous knotless weave producing a series of rhombi, wherein a vertex of each rhombus of the series of rhombi that is adjacent to the at least one tie devices is secured to the double hook of the at least one tie device, ends of each clear or white threads are thermo-sealed or thermo-fused to the corresponding one piece profile;

the protection net is a barrier device to prevent a person from falling from the opening;

wherein each tie device includes a curved central rib.

3. A protection net for openings, balconies, terraces, windows, staircases, or mezzanine surfaces, the protection net device consisting of:

a) a plurality of one piece profiles forming an open frame, each one piece profile having a convex upper face, a lower face, the convex upper face including a first curved side, a second curved side, and a central flat section placed between the first curved side and the second curved side, a plurality of nicks are formed on the convex upper face, at least one tie device protrudes from the second curved side towards the first curved side, each tie device including a double hook; and b) a net covering the open frame, the net being made of clear or white threads forming a discontinuous knotless weave producing a series of rhombi, wherein a vertex of each rhombus of the series of rhombi that is adjacent to the at least one tie devices is secured to the double hook of the at least one tie device, ends of each clear or white threads are thermo-sealed or thermo-fused to the corresponding one piece profile;

the protection net is a barrier device to prevent a person from falling from the opening;

wherein each profile is made of injected fiberglass reinforced polymided.

* * * * *